US007118249B2

(12) United States Patent
Hsu et al.

(10) Patent No.: US 7,118,249 B2
(45) Date of Patent: Oct. 10, 2006

(54) DECORATIVE ILLUMINATED ARTICLE ADAPTED FOR USE WITH A LIGHTING STRING

(76) Inventors: Fu-Hsien Hsu, 4F, No. 37, Lane 77, Sec. 2, Chung Shan North Road, Taipei (TW); John F. Cavanagh, 1980 Four Mile Creek Rd., Gainesville, GA (US) 30506

( * ) Notice: Subject to any disclaimer, the term of this patent is extended or adjusted under 35 U.S.C. 154(b) by 0 days.

(21) Appl. No.: 10/761,054

(22) Filed: Jan. 16, 2004

(65) Prior Publication Data

US 2005/0157497 A1 Jul. 21, 2005

(51) Int. Cl.
*F21V 21/08* (2006.01)
*F21S 13/00* (2006.01)

(52) U.S. Cl. ..... 362/249; 362/806; 362/653; 362/654; 362/386

(58) Field of Classification Search ..... 362/249, 362/391, 806, 386, 653, 654, 207; 315/185
See application file for complete search history.

(56) References Cited

U.S. PATENT DOCUMENTS 2,559,706 A * 7/1951 Brooks ..... 439/391
3,253,137 A * 5/1966 Richter, III ..... 362/293
3,727,044 A 4/1973 Monroy
3,767,910 A 10/1973 Harrigan
4,452,836 A * 6/1984 Daniel, Jr. ..... 428/11
4,544,218 A 10/1985 Sanders
4,667,276 A 5/1987 Cheng
4,924,358 A 5/1990 Heck
4,984,999 A 1/1991 Leake
4,998,186 A 3/1991 Cocca
5,451,842 A * 9/1995 Chien ..... 315/185 S
5,495,147 A 2/1996 Lanzisera
5,599,092 A * 2/1997 Yen ..... 362/294
5,618,103 A * 4/1997 Fussell ..... 362/386
5,964,520 A * 10/1999 Lee ..... 362/294
6,109,765 A * 8/2000 Blanton ..... 362/250
6,227,679 B1 5/2001 Zhang
6,319,056 B1 11/2001 Schunk
6,341,874 B1 * 1/2002 Rubin ..... 362/103
6,523,978 B1 * 2/2003 Huang ..... 362/252

* cited by examiner

*Primary Examiner*—Sandra O'Shea
*Assistant Examiner*—Anabel Ton
(74) *Attorney, Agent, or Firm*—Morris, Manning & Martin, LLP

(57) ABSTRACT

A decorative illuminated article adapted for use with a lighting string includes a wiring assembly including a length of wire having a first end and a second end, the first end connected to a male insert, the second end connected to a lighting assembly, a hollow enclosure including a decorative element contained therein and a neck adapted to receive the lighting assembly, and a clip attached to the wire for receiving a light bulb from the lighting string.

36 Claims, 10 Drawing Sheets

DECORATIVE ILLUMINATED ARTICLE ADAPTED FOR USE WITH A LIGHTING STRING

BACKGROUND

Traditional lighting strings include a plurality of light bulb assemblies arranged in spaced intervals along the length of a wire. When the lighting string is connected to a power source, the light bulbs are illuminated, thereby providing a decorative effect. Since the light bulbs assemblies are in close proximity to the wire, the decorative light is also centralized around the wire.

Various decorative ornaments are known in the art. Some ornaments are provided with an electrical cord or a battery to provide an illuminating effect on the ornament. Such ornaments, while visually pleasing, are often limited in use because the ornament must be placed in close proximity to the power source such as an electrical outlet. Even where a battery is used, the ornament must be positioned in a location, for example, on a tree, where the battery pack will be concealed. While battery-operated ornaments provide an advantage over the corded ornaments, such ornaments require maintenance as the battery has a limited life. Thus, there is a need for an improved means of providing an ornament that can be illuminated for an extended period of time without the need for a separate source of electrical power.

Some improved ornaments have been disclosed in U.S. Pat. No. 4,544,218 to Sanders et al. and U.S. Pat. No. 6,612,864 to Hsu. While such ornaments provide an advantage over the prior battery operated devices, there remains a need for improved ornamental devices with additional features to enhance flexibility and usability of the illuminated article.

SUMMARY OF THE INVENTION

The present invention generally relates to a decorative illuminated article adapted for use with a conventional lighting string.

According to a first aspect of the present invention, the decorative illuminated article includes a wiring assembly including a length of wire having a first end and a second end, the first end connected to a male insert, the second end connected to a lighting assembly, a hollow enclosure including a decorative element contained therein and a neck adapted to receive the lighting assembly, and a clip attached to the wire for receiving a light bulb from the lighting string. The clip may be removably attached to the wire for selective placement along the length of the wire.

In one variation of the first aspect of the present invention, the clip includes at least two substantially parallel segments connected at one end and having a circular void therebetween. The void is dimensioned to receive a light bulb. As such, the segments are sufficiently flexible to be partially and temporarily separated to receive a light bulb within the void.

In another variation of the first aspect of the present invention, the clip includes a first segment and a second segment, the first segment and the second segment joined at one end, and a first void and a second void formed between the first segment and the second segment. The first void is dimensioned to receive a wire, and the second void is dimensioned to receive a light bulb.

In another variation of this aspect, the lighting assembly includes a plurality of light emitting diodes (LEDs) and a base for supporting the plurality of LEDs.

According to a second aspect of the present invention, the decorative illuminated article includes a wiring assembly including a length of wire having a first end and a second end, the first end connected to a male insert, the second end connected to a lighting assembly, a hollow enclosure including a decorative element contained therein and a neck having an opening sized to receive the lighting assembly, and a collar having a hole through which the wire is inserted, the collar slidably positioned between the first end and the second end and having a interior surface adapted to receive the neck.

In one variation of the second aspect of the present invention, the article further includes a threaded gasket positioned around the neck. In such a variation, the interior surface of the collar is adapted to threadably receive the neck.

In a second variation of the second aspect of the present invention, the article further includes a clip removably attached to the wire, the clip including at least one circular void dimensioned to receive a light bulb from the lighting string.

In a third variation of the second aspect, the lighting assembly includes a plurality of LEDs and a base for supporting the plurality of LEDs.

According to a third aspect of the present invention, a decorative illuminated article adapted for use with a lighting string includes a wiring assembly including a length of wire having a first end and a second end, the first end connected to a male insert and the second end connected to a lighting assembly, the male insert including a base and a husk, the husk including a pair of resilient tabs having a fixed end flexibly attached to and extending angularly from opposed sides of the husk in a coaxially aligned spaced apart relation, where each tab is adapted to deflect in a direction toward the opposed tab upon application of a biasing force and protrude in a direction away from the opposed tab upon removal of the biasing force, and a hollow enclosure including a decorative element contained therein and a neck having an opening sized to receive the lighting assembly. The use of one of more resilient tabs enables the male insert to fit into a plurality of different sized sockets of various lighting strings. In one variation of this aspect, the lighting assembly includes a plurality of LEDs and a base for supporting the plurality of LEDs.

According to a fourth aspect of the present invention, a decorative illuminated article includes a wiring assembly including a length of wire having a first end connected to a male insert and a second end connected to a lighting assembly, the lighting assembly including a plurality of LEDs and a base for supporting the plurality of LEDs, a hollow enclosure including a decorative element contained therein and a neck having an opening for receiving the lighting assembly, a threaded gasket fittedly positioned around the neck, a collar having a hole through which the wire is inserted, the collar slidably positioned between the first end and the second end and having a interior surface adapted to threadably receive the neck, and a clip removably attached to the wire, the clip including a circular void dimensioned to receive a light bulb from a lighting string.

In one variation of this aspect, the lighting assembly includes a plurality of LEDs and a base for supporting the plurality of LEDs.

In another variation of this aspect, the male insert includes a base and a husk, where the husk includes a pair of resilient tabs having a fixed end flexibly attached to and extending angularly from opposed sides of the husk in a coaxially aligned spaced apart relation, and each tab is adapted to deflect in a direction toward the opposed tab upon application of a biasing force and protrude in a direction away from the opposed tab upon removal of the biasing force.

DETAILED DESCRIPTION OF THE INVENTION

The present invention relates generally to a decorative illuminated article that is adapted for use with a lighting string. The decorative illuminated article is capable of being removably attached to any position on a lighting string, thereby affording the user considerable flexibility in positioning the article on the lighting string, for example, on a holiday tree.

Figure 1:
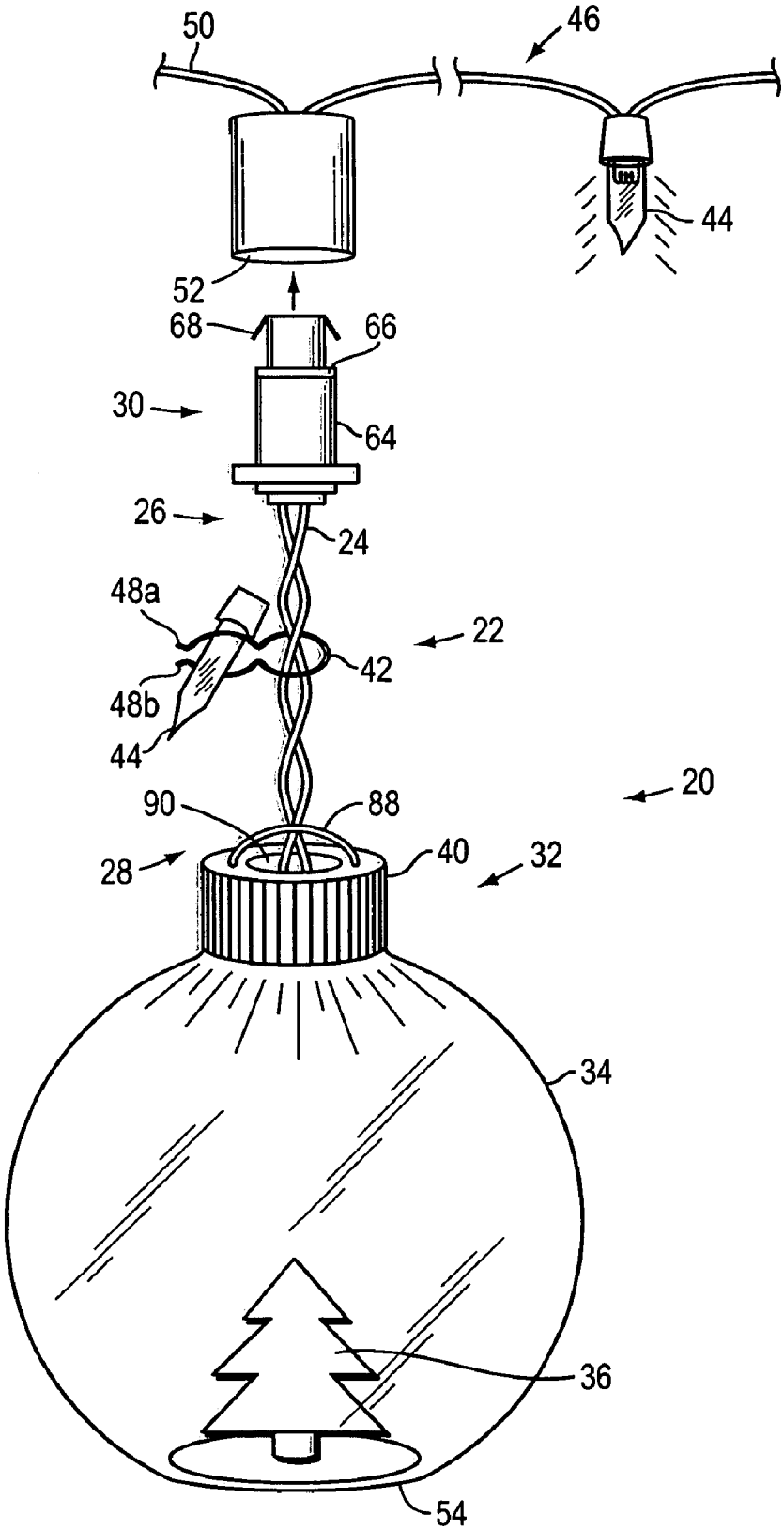
FIG. 1 depicts an exemplary decorative illuminated article according to the present invention.
Figure 2:
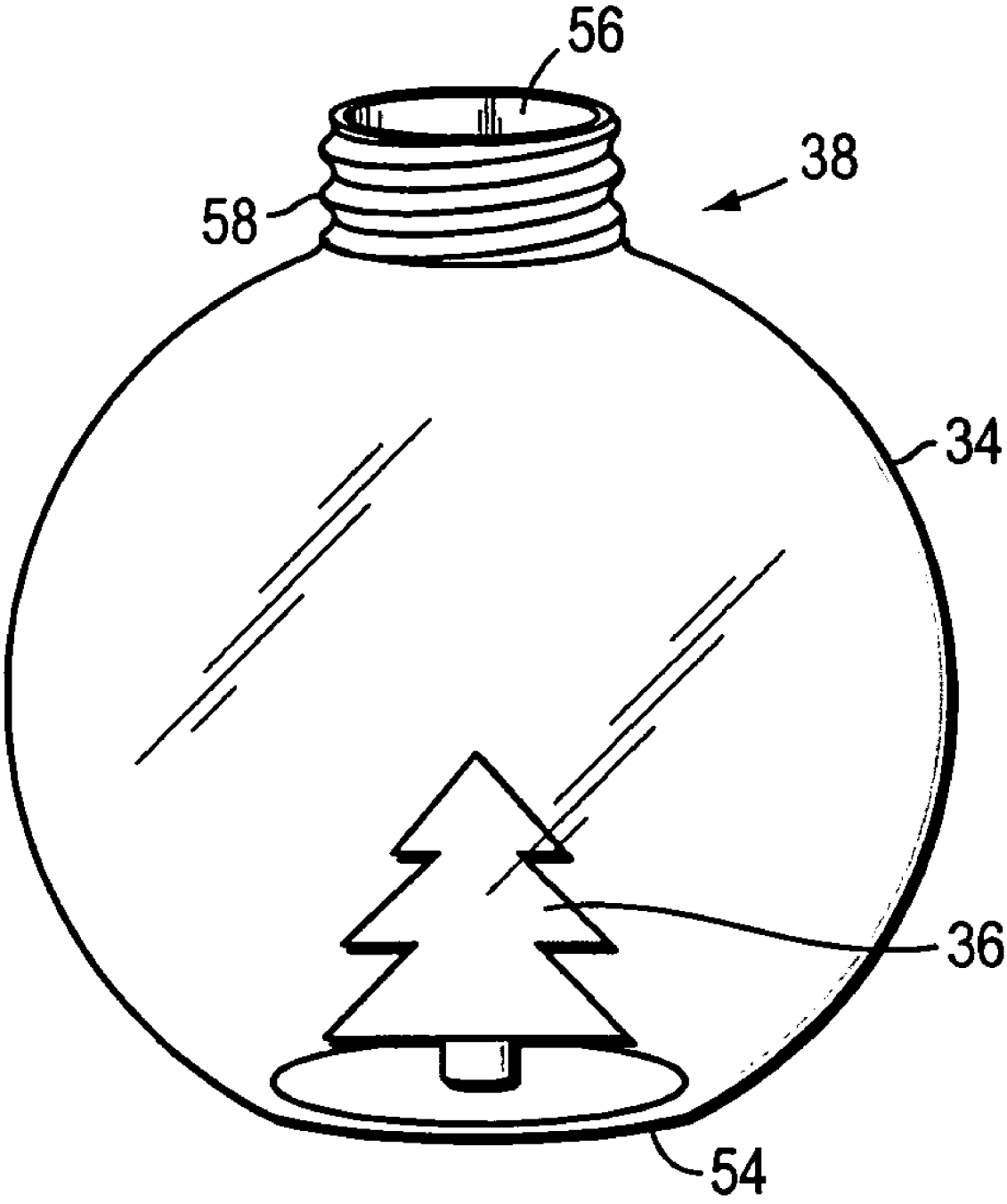
FIG. 2 depicts an exemplary enclosure that may be used in accordance with the present invention.

As depicted in FIG. 1, an exemplary decorative illuminated article 20 according to the present invention includes a wiring assembly 22 including a length of wire 24 having a first end 26 and a second end 28, where the first end 26 is connected to a male insert 30, and the second end 28 is connected to a lighting assembly 32. An article 20 according to the present invention further includes a hollow enclosure 34 containing a decorative element 36 therein and a neck 38 (best seen in FIGS. 2, 3, and 8) adapted to receive the lighting assembly 32. An article 20 according to the present invention may further include a collar 40 for securing the wiring assembly 22 to the enclosure 34. An article 20 according to the present invention may further include a clip 42 for holding a light bulb 44 from a conventional lighting string 46.

The wiring assembly 22 is adapted to be connected to a conventional lighting string 46. As is known to those of skill in the art, a conventional lighting string 46 typically includes an AC plug (not shown), a length of electrical wiring 50, and a plurality of sockets 52 for receiving a light bulb 44 in a spaced relation along the length of the wiring 50. To provide power to the lighting assembly 32 and illuminate the decorative article 20, the male insert 30 of the wiring assembly 32 is inserted into an empty socket 52 of the lighting string 46. Thus, the user of the illuminated article 20 of the present invention can select any location to hang the article 20 along the lighting string 46, for example, on a Christmas tree, mantle, window frame, and so forth, without having to be limited by placing the article 20 near an additional power source.

Figure 3:
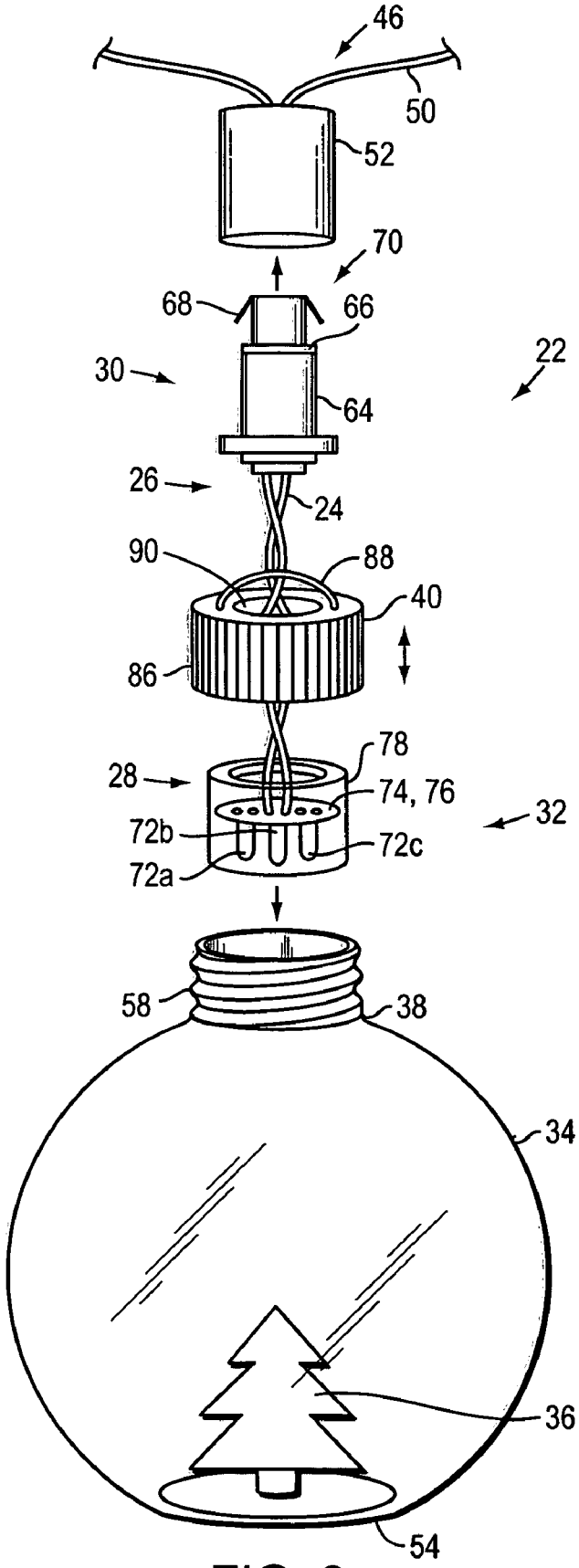
FIG. 3 depicts a wiring assembly according to the present invention in relation to a lighting string and decorative enclosure.

FIG. 3 further depicts an exemplary collar 40 according to the present invention, discussed in greater detail in connection with FIGS. 8A–8C. According to one aspect of the present invention, the collar 40 is an individual component that may be slidably positioned between the first end 26 and the second end 28, independent from the lighting assembly 32. The collar 40 includes an interior space 60 (best seen in FIG. 8B) dimensioned to receive the lighting assembly 32. According to another aspect on the invention (not shown), the collar 40 is integral with the lighting assembly 32 and is fixedly positioned at the second end 28 of the wire 24.

The enclosure 34 includes a neck 38. The neck 38 is generally cylindrical in shape and includes a circular opening 56. The opening 56 is sized to receive at least a portion of the lighting assembly 32. The neck 38 may further include a threaded gasket 58 positioned around the exterior of the neck 38. The gasket 58 may typically be formed from a flexible or elastomeric material, such as rubber, so that the gasket 58 fits securely around the neck 38.

The enclosure 34 may include a decorative element 36 made from any suitable material in any shape desired. Some examples of decorative elements 36 include a Christmas tree, reindeer, angel, snowflake, snowman, Santa Claus, poinsettia, candle, manger scene, and so forth. In some embodiments, the enclosure 34 may have a flat bottom 54 to provide a platform to place the decorative element 36. In other embodiments, the decorative element 36 may be suspended (not shown) from the neck 38 to create a floating or rotating effect in the enclosure 34.

Turning to FIGS. 3–7, various aspects of a wiring assembly 22 according to the present invention are illustrated. The wiring assembly 22 includes a length of wire 24 having a first end 26 and a second end 28 (FIG. 3). The first end 26 is connected to a male insert 30, further described in connection with FIGS. 4–6. The second end 28 is connected to a lighting assembly 32, described in greater detail in connection with FIGS. 7A–7B.

FIG. 3 further depicts an exemplary collar 40 according to the present invention, discussed in greater detail in connection with FIGS. 8A–8C. According to one aspect of the present invention, the collar 40 is an individual component that may be slidably positioned between the first end 26 and the second end 28, independent from the lighting assembly 32. The collar 40 includes an interior space 62 (best seen in FIG. 8B) dimensioned to receive the lighting assembly 32. According to another aspect of the invention (not shown), the collar 40 is integral with the lighting assembly 32 and is fixedly positioned at the second end 28 of the wire 24.

Figure 4:
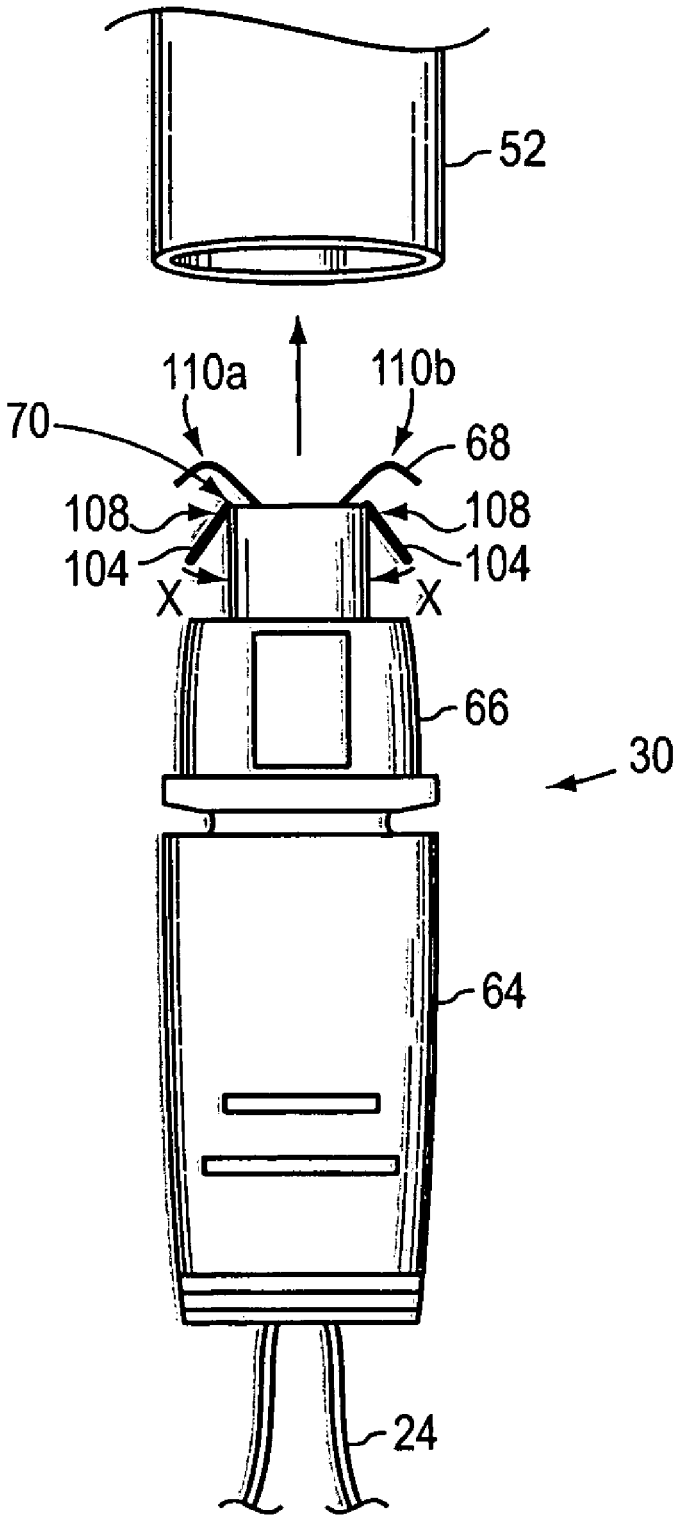
FIG. 4 depicts an exemplary universal fit male insert that may be used in accordance with the present invention.

As illustrated in FIG. 4, the male insert 30 generally includes a cylindrical base 64 and a husk 66. The male insert 30 includes a pair of bendable wire leads 68 that extend from an insertable end 70 of the male insert 30. As is understood by those skilled in the art, the wire leads 68 extend outwardly from and are bent over the insertable end 70 of the male insert 30 to bring electrical power to the male insert 30 when the male insert 30 is inserted into a socket 52 of a lighting string 46.

According to one aspect of the present invention depicted in FIG. 4, the male insert 30 includes a universal husk 66 that enables the male insert 30 to fit inside various standard lighting string sockets 52. The husk 66 and base 64 may form a single integral component or may be separate pieces joined by various means known to those of skill in the art. The universal husk 66 includes at least one resilient tab 104 for enabling the male insert 30 to fit snugly inside a socket 52 of a conventional lighting string 46.

In some variations, the resilient tab 104 includes a fixed end 108 flexibly attached to and extending angularly from the husk 66. In some instances, the tab 104 is attached to and extending angularly from the insertable end 70 of the male insert 30. The tab 104 is flexibly affixed to the husk 66 such that it is sufficiently resilient to undergo multiple insertions and removals. Thus, upon application of a biasing force, the tab 104 deflects in a direction toward the husk 66. Upon removal of the biasing force, the tab 104 protrudes in a direction away from the husk 66.

Where more than one tab 104 is present, for example, where two tabs 104 are present (FIG. 4), the tabs 104 may be positioned on the husk 66 so that the tabs 104 are in a coaxially aligned spaced apart relation on opposing sides 110*a* and 110*b* of the husk 66. As above, the tabs 104 may be attached to and extending angularly from the insertable end 70 of the male insert 30.

Each tab 104 is flexibly affixed to the husk 66 at one end 108 and sufficiently resilient to undergo multiple insertions and removals. Thus, upon application of a biasing force, each tab 104 deflects in a direction toward the opposed tab 104, and upon removal of the biasing force, each tab 104 protrudes in a direction away from the opposed tab 104.

Thus, as the male insert 30 is inserted into the socket 52, the resilient tabs 104 are subjected to a biasing force upon contact with the socket 52, thereby causing the tabs 104 to deflect in a direction X toward the opposed tab 104. When the male insert 30 is fully inserted into the socket 52 and the biasing force is removed, the tabs 104 tend to deflect away from the opposed tab 104. This enables the male insert 30 to be securely held in position inside the socket 52.

The resilient tab 104 may be made of any suitable material, such as a polymer, metal, or the like, provided that the material possesses sufficient flex characteristics at the desired tab 104 dimensions. Further, the tab 104 may have any thickness, provided that the ability of the tab 104 to deflect during insertion and removal of the male insert 30 is not impeded. In some embodiments, the tabs 104 are formed from sufficiently flexible plastic using molding techniques known to those skilled in the art. Alternatively, the tab 104 may be constructed of various components joined together thermally, adhesively, by solder, or the like.

Whether the tab 104 possesses sufficient flexibility is governed by fundamental principles of mechanics. The resilient tab 104 will be deflected multiple times during insertion and removal of the male insert 30, so it is imperative that the strain on the tab 104 does not exceed the maximum allowable dynamic strain on the particular material. Strain on the tab 104 is a function of both the dimensions of the tab 104 and its ability to deflect. Methods of calculating strain on the tab 104 are well known to those of ordinary skill in the art. The maximum allowable dynamic strain for a given material is readily available from the material supplier and is often presented as a stress-strain curve. Suitable materials for the present invention may include, but are not limited to, various polymers, metals, composite materials, and so forth.

An additional consideration in designing the resilient tab 104 is whether a fillet radius should be used at points of high stress. A sharp corner at the juncture between the tab 104 and the husk 66 may be a point of high stress (when inserting and removing the male insert 30) at which yielding or breakage may occur. Use of a fillet radius may help to alleviate the stress and extend the life of the tab 104.

Where a universal fit husk 66 is not provided with the article 20 of the present invention, and the husk is not dimensioned to properly fit within the socket 52 of a conventional lighting string, the article 20 may be provided with a removable husk 106. Thus, according to another aspect of the present invention depicted in FIGS. 5A–5B, the illuminated decorative article 20 is provided with a male insert 30 having a removable husk 106 (FIG. 5A) that can be replaced or adapted as needed to enable the male insert 30 to properly fit into the socket 52 of the lighting string 46. In such instances, the removable husk 106 may be removed from the male insert 30 and replaced with a light bulb shell 100 (best seen in FIG. 6) from the lighting string 46.

Figure 5A:
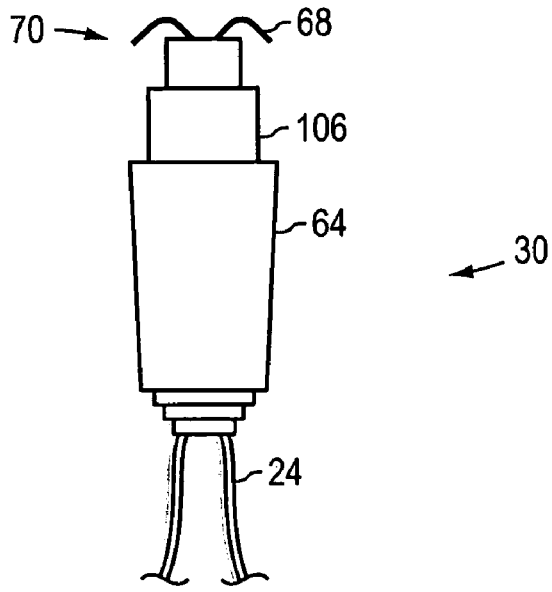
FIG. 5A depicts another exemplary male insert that may be used in accordance with the present invention.
Figure 5B:
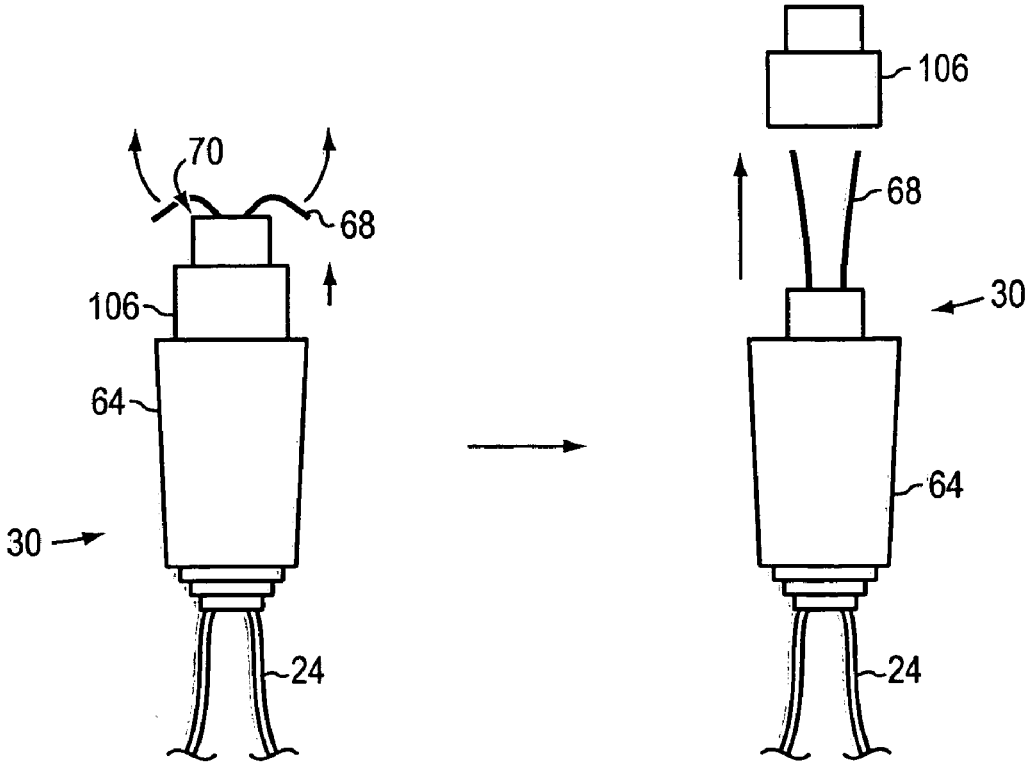
FIG. 5B depicts removal of the husk from an exemplary male insert for adaptation with conventional lighting strings.
Figure 6:
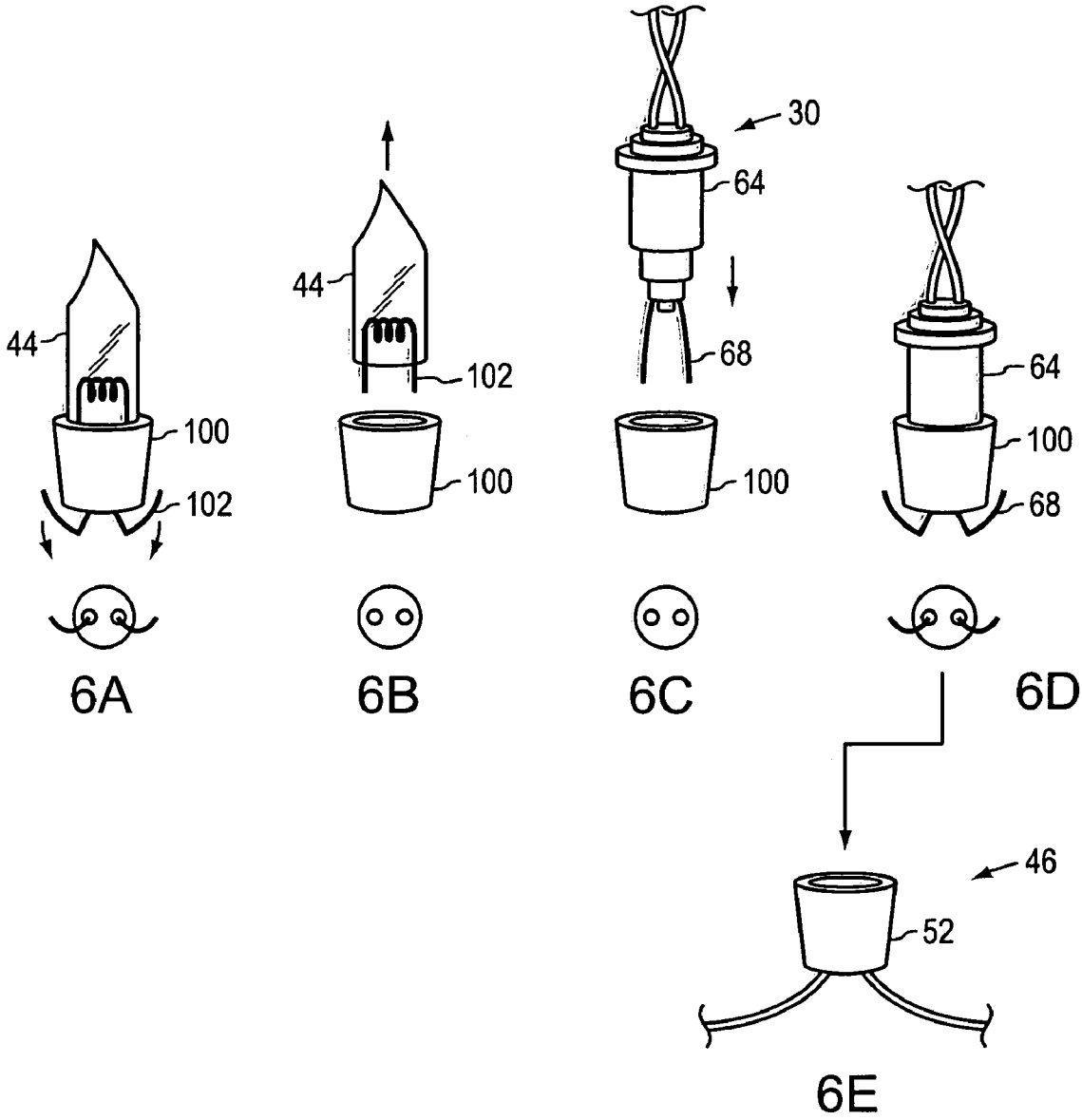
FIG. 6 depicts removal of a husk from a lighting string for use with the wiring assembly of the present invention.

To do so, the wire leads 68 extending from the husk 106 are bent into a linear configuration, and the husk 106 is separated from the base 64 (FIG. 5B).

After the husk 106 has been removed from the male insert 30, FIGS. 6A–6E depict the manner in which the husk 106 is replaced with a light bulb shell 100 from a conventional lighting string 46.

First, a light bulb 44 and light bulb shell 100 are removed from a socket 52 of a lighting string 46 (not shown).

Next, at FIGS. 6A–6B the light bulb 44 is removed from the shell 100 by bending the wire leads 102 into a linear configuration and gently pulling the bulb 44 from the shell 100.

Next, at FIG. 6C the male insert 30 of the lighting assembly 32, with wire leads 68 in a linear configuration, is inserted into the shell 100. According to one aspect of the present invention, the male insert 30, in particular, the base 64, may include one or more stepped or tapered cylindrical sections (not shown) that allow the base 64 to fit into various different sized shells 100 (not shown).

Next, at FIG. 6D the wire leads 68 are bent into an arcuate configuration to lie alongside the surface of the shell 100 and serve as electrical connectors for the lighting assembly 32 (not shown).

Next, at FIG. 6E the assembled shell 100 and base 64 are inserted into a light bulb socket 52 on a lighting string 46, thereby providing power to the lighting assembly 32 (not shown).

Figure 7A:
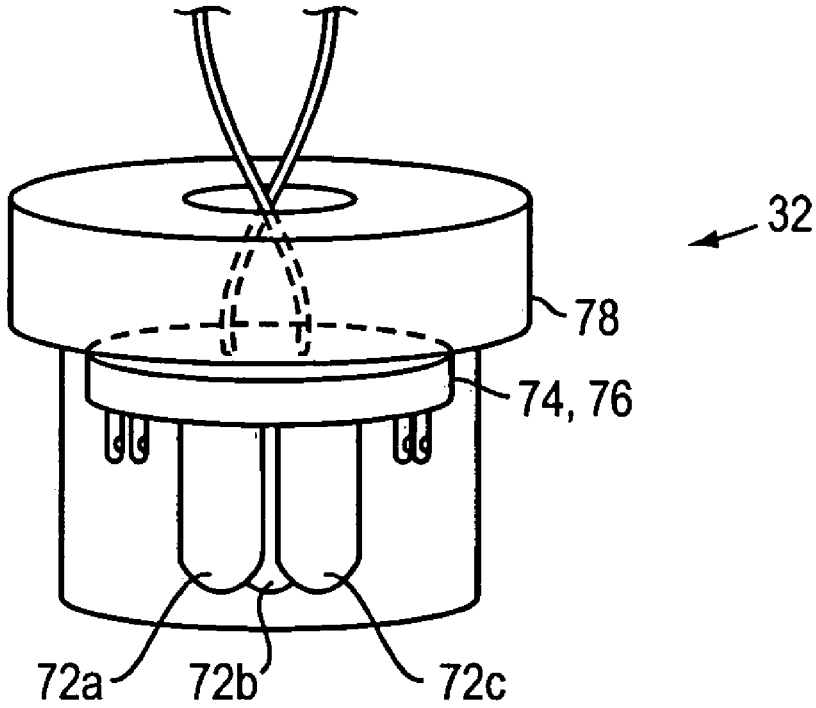
FIG. 7A depicts a side plan view of exemplary lighting assembly that may be used in accordance with the present invention.
Figure 7B:
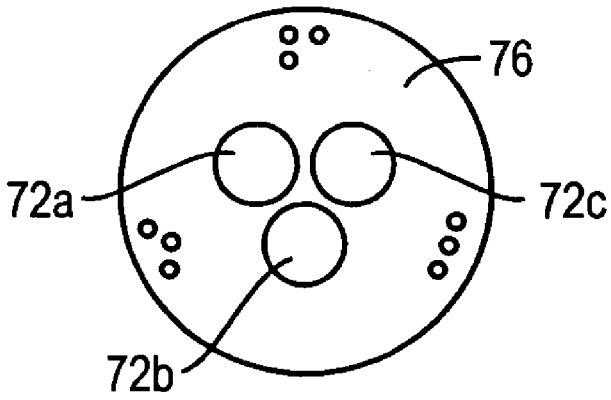
FIG. 7B depicts a bottom plan view of an exemplary circuit board supporting multiple LEDs in accordance with the present invention.

FIGS. 7A–7B illustrate an exemplary lighting assembly 32 that may be used with the present invention. The lighting assembly 32 includes a plurality of light emitting diodes (LEDs) 72*a*, 72*b*, and 72*c* and a supporting base 74. In some instances, a circuit board 76 may serve as the base 74 on which the LEDs 72*a*, 72*b*, and 72*c* are supported. The circuit board 76 supplies power to the LEDs 72*a*, 72*b*, and 72*c* and controls the lighting pattern and/or sequence, intensity variation, and power conversion as needed. The circuit board 76 may include driver circuitry configured to turn the color LEDs 72*a*, 72*b*, and 72*c* on and off at a selected frequency, intensity, and pattern to create a pleasing multi-color lighting effect.

According to one aspect of the present invention, the lighting assembly 32 includes a plurality of LEDs 72*a*, 72*b*, and 72*c* supported on a circuit board 76 and a housing 78 that fits within the neck 38 of the enclosure 34. The housing 78 is preferably a transparent or translucent plastic member. The housing 78 may be formed from one or more plastic components assembled and adhered together using an adhesive material.

Figure 8A:
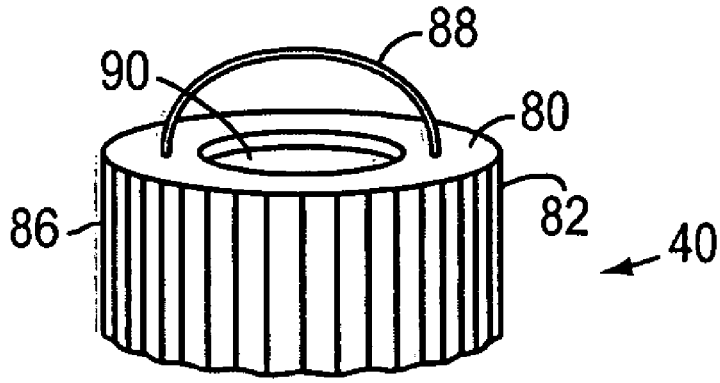
FIG. 8A depicts a perspective view of an exemplary collar that may be used in accordance with the present invention.
Figure 8B:
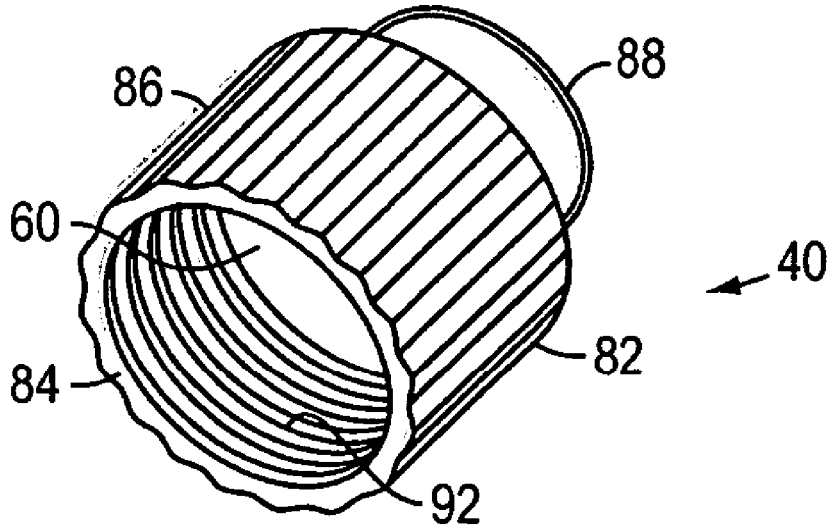
FIG. 8B depicts a perspective view of the interior of an exemplary collar that may be used in accordance with the present invention.
Figure 8C:
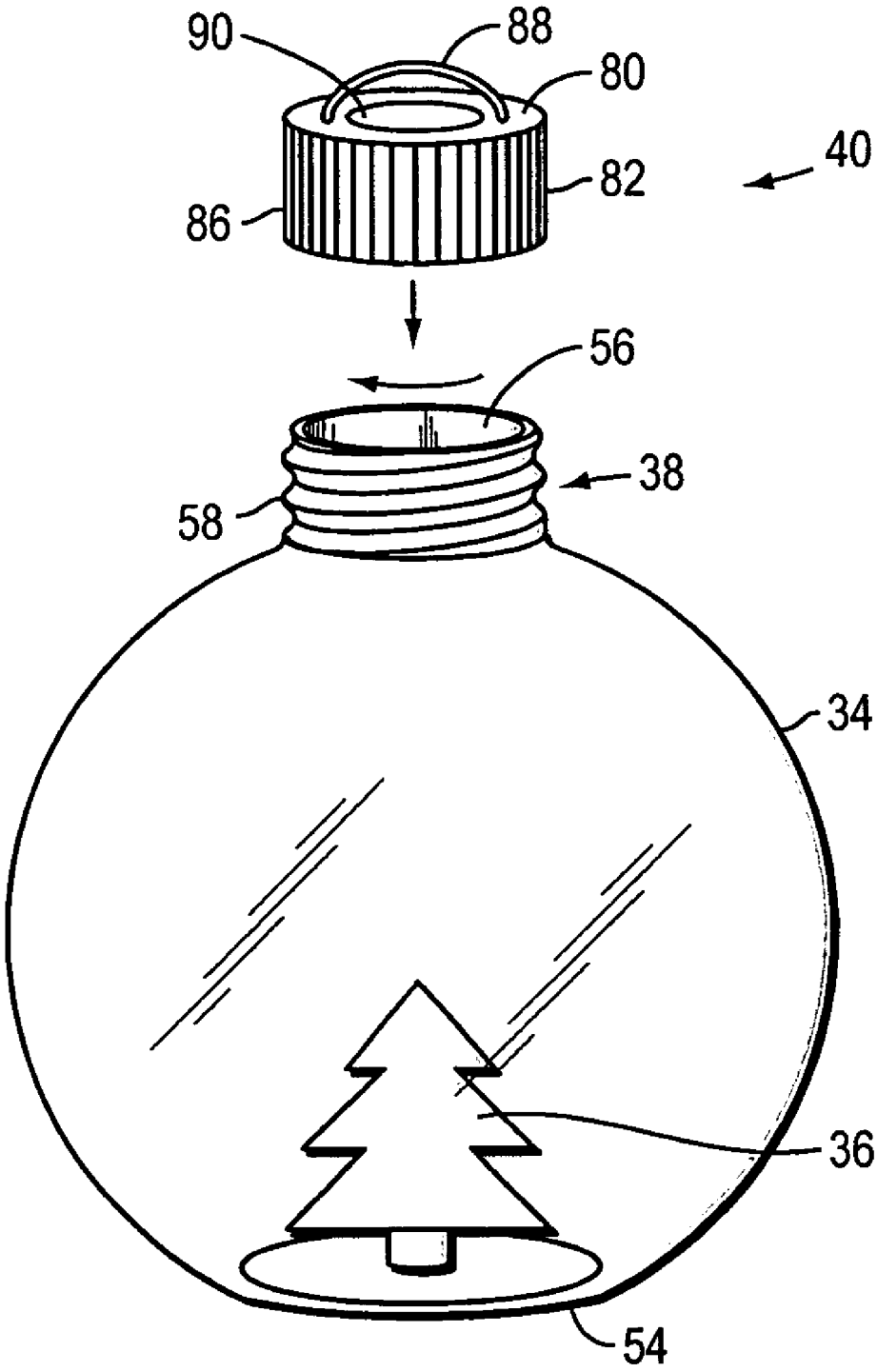
FIG. 8C depicts an exemplary collar that may be used with the present invention threadbly engaging an exemplary decorative enclosure.

Turning to FIGS. 8A-8C, a decorative collar 40 that may be used with the present invention is shown. As depicted in FIGS. 8A-8B, the collar 40 is at least partially hollow to receive and conceal the components of the lighting assembly 32 positioned inside the neck 38 (best seen in FIGS. 1 and 3). The collar 40 further provides an ornamental feature to the decorative illuminated article 20 (FIG. 1).

The collar 40 is generally cylindrical and includes a substantially planar surface 80, a tubular surface 82 and an interior space 60. The tubular surface 82 includes an interior surface 84 and an exterior surface 86. The exterior surface 86 of collar 40 may include decorative ribbing or knurls, or any other suitable decorative design. The planar surface 80 includes a hole 90 through which the wire 24 is inserted (not shown). According to one aspect of the present invention, the collar 40 may include an arcuate metal hanger 88 that can be used to suspend the decorative illuminated article 20 and the associated enclosure 34 from a supporting structure, such as a nail, a hook, or a tree branch (not shown).

Turning to FIGS. 8B–8C, according to another aspect of the present invention, the collar 40 is generally dimensioned and adapted to engage the neck 38 of the enclosure 34. Where a threaded gasket 58 is provided on the neck 38, the collar 40 may include threading 92 on the interior surface 84 (FIG. 8B) to engage the neck 38.

To secure the collar 40 to the neck 38, the collar 40 is aligned with the neck 38 and rotated in a twisting or screwing manner onto the threaded gasket 58. While use of complementary threading to engage the collar 40 and the neck 38 is described in detail herein, it should be understood that other means of securing the collar 40 to the neck 38 are contemplated by the present invention. However, use of a threaded collar 40 may be preferred in some instances where the enclosure 34 is particularly heavy or where other support means such as tension-based support means may not adequately support a heavy, yet delicate enclosure.

When the collar 40 is secured to the neck 38 of the enclosure 34, the planar surface 80 is substantially parallel to the opening 56 of the neck 38.

Turning to FIGS. 9A–9D, the article 20 of the present invention may include a light bulb clip 42. As is known to those familiar with lighting strings, a light bulb 44 from a lighting string 46 is small and easily misplaced. Removal of a light bulb 44 for use with the illuminated decorative article 20 of the present invention presents a risk of misplacing the bulb 44 removed from the socket 52. The light bulb clip 42 according to the present invention provides a convenient mechanism to retain a removed light bulb 44 in proximity to the socket 52 from which it was removed for later replacement.

Figure 9A:
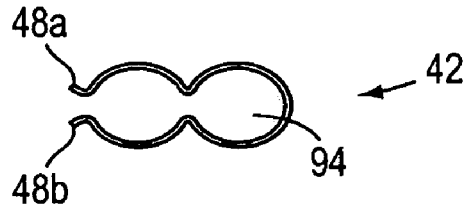
FIG. 9A depicts an exemplary clip for use in accordance with the present invention.

As shown in FIG. 9A, the clip 42 generally includes at least two substantially parallel segments 48*a* and 48*b* joined or connected at one end. The clip 42 includes circular voids 94 with separations or slits positioned along an axis of the voids 94 to allow the plastic to be partially and temporarily separated to receive the wires 24 of the wiring assembly 22 and a light bulb 44, and firmly hold the bulb 44 in place for later retrieval.

Figure 9B:
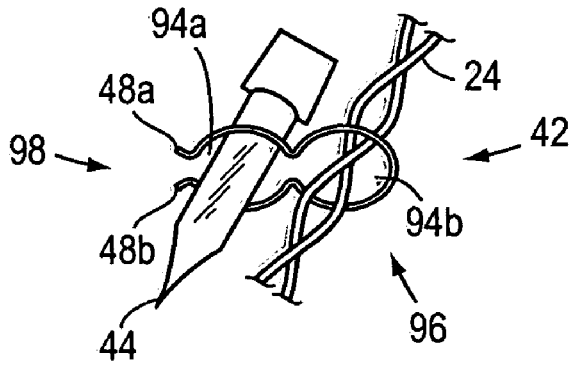
FIG. 9B depicts an exemplary clip having two voids for receiving a wire and a light bulb for use in accordance with the present invention.

According to one aspect of the present invention, the clip 42 includes a closed end 96, an open end 98, and two voids 94*a* and 94*b* formed by the segments 48*a* and 48*b* between the closed end 96 and the open end 98. As illustrated in FIG. 9B, the closed end 96 may be used to secure the clip 42 to the wire 24, while the open end 98 is available to receive a light bulb 44 removed from a socket 52.

Figure 9C:
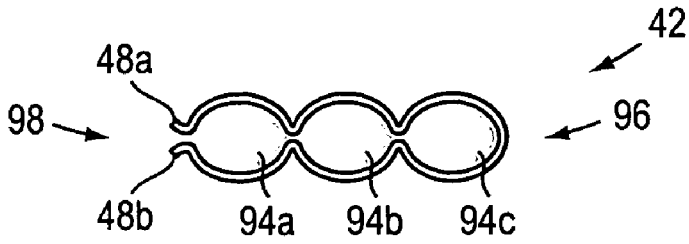
FIG. 9C depicts an exemplary clip having three voids for receiving two individual wires and a light bulb for use in accordance with the present invention.

According to another aspect of the present invention shown in FIG. 9C, the clip 42 includes a closed end 96, an open end 98, and three voids 94*a*, 94*b*, and 94*c* formed by the segments 48*a* and 48*b* between the closed end 96 and the open end 98. In this instance, the void 94*c* proximal the closed end 96 may be used to secure one of the two wires used to form the length of wire 24 (not shown), the void 94*b* may be used to secure the other of the two wires used to form the length of wire 24 (not shown), and the void 94*a* distal the closed end is available to receive a light bulb 44 removed from a socket 52 (not shown).

Figure 9D:
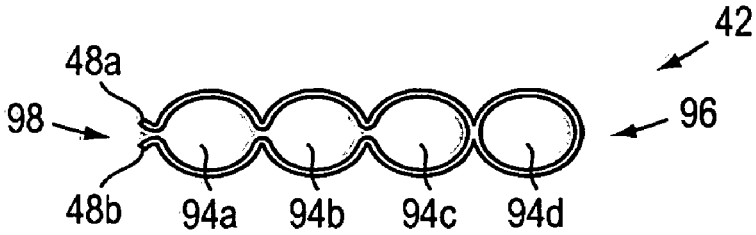
FIG. 9D depicts an exemplary clip having three voids for receiving two individual wires and a light bulb, and an integral end for structural integrity for use in accordance with the present invention.

According to yet another aspect of the present invention depicted in FIG. 9D, the clip 42 includes an integral closed end 96 for structural integrity, while the open end 98 includes a slit for receiving the wires 24 and bulb 44 as above. Thus, voids 94*a*, 94*b*, and 94*c* are available for receiving a wire 24 or a light bulb 44, and void 94*d* is closed to enhance the structural integrity of the clip 42.

The clip 42 may be formed from any suitable material that it sufficiently flexible to enable the segments 48*a* and 48*b* to be deflected for insertion of items to be retained, while sufficiently resilient to permit repeated deflection of the segments 48*a* and 48*b* without fracture. Examples of materials that may be suitable for use with the clip 42 of the present invention include polypropylene and other thermoplastic materials, spring steel, heavy gauge wire, and so forth.

As will be apparent from the above description and figures and the appended claims, the decorative illuminated article 20 is readily assembled without difficulty. The lighting assembly 32 is sized to fit within the neck 38 of the enclosure 34. Thus, to assemble the decorative illuminated article 20, the lighting assembly 32 is inserted into the opening 56 of the neck 38, the collar 40 is slid toward the second end 28 of the wire 24, and the collar 40 is aligned with the neck 38 and screwed onto the threaded gasket 58 on the neck 38.

The male insert 30 of the wiring assembly 22 is then inserted into any socket 52 on a traditional lighting string 46.

To do so, the desired location is first identified. The bulb 44 in that socket 52 is then removed from the socket 52. The male insert 30 is then inserted into the socket 52. The light bulb 44 removed from the socket 52 may then be placed in the clip 42, where provided, by manually separating the segments 48*a* and 48*b* of the clip 42, placing the bulb 44 into a clip void 94, and allowing the segments 48*a* and 48*b* to return to their original position. In this state, the segments 48*a* and 48*b* of the clip 42 firmly hold the bulb 44 for later retrieval and return to the light socket 52. The clip 42 may be removably attached to the wire 24 so that the clip 42 may be positioned anywhere along the length of the wire 24. This enables the clip 42 and light bulb 44 to be placed in a position along the length of the wire 24 that conceals both from view. Thus, the clip 42 is visually inconspicuous and yet provides a convenient and effective means of securely storing the light bulb 44 removed from the socket.

When assembled, the LEDs 72*a*, 72*b*, and 72*c* of the lighting assembly 32 are available to illuminate the decorative element 36 contained within the enclosure 34. As stated above, in some instances, the LEDs 72*a*, 72*b*, and 72*c* include a red LED, a blue LED, and a green LED that may be lighted sequentially. The effect is that the decorative element 36 is sequentially illuminated in various colors, thereby creating a pleasing visual effect.

Accordingly, it will be readily understood by those persons skilled in the art that, in view of the above detailed description of the preferred embodiments and articles of the present invention, the present invention is susceptible of broad utility and application. Many methods, embodiments, and adaptations of the present invention other than those herein described, as well as many variations, modifications, and equivalent arrangements will be apparent from or reasonably suggested by the present invention and the above detailed description thereof, without departing from the substance or scope of the present invention. Accordingly, while the present invention is described herein in detail in relation to preferred embodiments, it is to be understood that this detailed description is only illustrative and exemplary of the present invention and is made merely for purposes of providing a full and enabling disclosure of the present invention. The detailed description set forth herein is not intended nor is to be construed to limit the present invention or otherwise to exclude any such other embodiments, adaptations, variations, modifications, and equivalent arrangements of the present invention, the present invention being limited solely by the claims appended hereto and the equivalents thereof.

What is claimed is:

1. A decorative illuminated article for use in connecting to a pre-existing socket of a lighting string comprising a plurality of sockets that hold decorative light bulbs, comprising:

a wiring assembly including a length of wire having a first end and a second end, the first end connected to a male insert configured for insertion into one of the pre-existing sockets of the lighting string, the second end connected to a lighting assembly;

a lighting assembly including a light far illuminating a decorative element and configured for association with an enclosure for the decorative element;

a hollow enclosure including the decorative element contained therein and a neck adapted to receive the lighting assembly; and a clip attached to the wire for receiving a light bulb removed from the one of the pre-existing sockets of the lighting string.

2. The article of claim 1, the clip comprising at least two substantially parallel segments connected at one end and having a circular void therebetween.

3. The article of claim 1, wherein the clip is removably attached to the wire.

4. The article of claim 1, wherein the lighting assembly comprises a plurality of LEDs and a base for supporting the plurality of LEDs.

5. The article of claim 1, the clip comprising a first segment and a second segment, the first segment and the second segment joined at one end, and a first void and a second void formed between the first segment and the second segment.

6. The article of claim 2, the void dimensioned to receive a light bulb.

7. The article of claim 2, wherein the segments are sufficiently flexible to be partially and temporarily separated to receive a light bulb within the void.

8. The article of claim 5, wherein the first void is dimensioned to receive a wire, and the second void is dimensioned to receive a light bulb.

9. A decorative illuminated article for use in connecting to a pre-existing socket of a lighting string comprising a plurality of sockets that hold decorative light bulbs, comprising:

a wiring assembly including a length of wire having a first end and a second end, the first end connected to a male insert configured for insertion into one of the pre-existing sockets of the lighting string, the second end connected to a lighting assembly;

a hollow enclosure including a decorative element contained therein and a neck having an opening sized to receive the lighting assembly in a position to illuminate the decorative element;

a threaded gasket positioned around the neck; and a collar having a hole through which the wire is inserted, the collar slidably positioned between the first end and the second end, the collar having an interior surface adapted to receive the neck.

10. The article of claim 9, wherein the interior surface of the collar is adapted to threadably receive the neck.

11. The article of claim 9, the collar further having an exterior surface including decorative ribbing or knurls.

12. The article of claim 9, the collar comprising an arcuate metal hanger.

13. The article of claim 9, wherein the lighting assembly comprises a plurality of LEDs and a base for supporting the plurality of LEDs.

14. The article of claim 10, further comprising a clip removably attached to the wire, the clip including at least one circular void dimensioned to receive a light bulb from the lighting string.

15. A decorative illuminated article for use in connecting to a pre-existing socket of a lighting string comprising a plurality of sockets that hold decorative light bulbs, comprising:

a wiring assembly including a length of wire having a first end and a second end, the first end connected to a male insert configured for insertion into one of the pre-existing sockets of the lighting suing and the second end connected to a lighting assembly, the male insert comprising a base and a husk, the husk including a pair of resilient tabs having a fixed end flexibly attached to and extending angularly from opposed sides of the husk in a coaxially aligned spaced apart relation, wherein each tab is adapted to deflect in a direction toward the opposed tab upon application of a biasing force and protrude in a direction away from the opposed tab upon removal of the biasing force; and a hollow enclosure including a decorative element contained therein and a neck having an opening sized to receive the lighting assembly in a position to illuminate the decorative element.

16. The article of claim 15, wherein the lighting assembly comprises a plurality of LEDs and a base for supporting the plurality of LEDs.

17. A decorative illuminated article adapted for use wit a lighting string comprising:

a wiring assembly including a length of wire having a first end connected to a male insert and a second end connected to a lighting assembly, the lighting assembly comprising a plurality of LEDs and a base for supporting the plurality of LEDs;

a hollow enclosure including a decorative element contained therein and a neck having an opening for receiving the lighting assembly, a threaded gasket fittedly positioned around the neck;

a collar having a hole through which the wire is inserted, the collar slidably positioned between the first end and the second end, the collar having an interior surface adapted to threadably receive the neck; and a clip removably attached to the wire, the clip including a circular void dimensioned to receive a light bulb from a lighting string.

18. The article of claim 17, wherein the male insert comprises a base and a removable husk.

19. The article of claim 17, wherein the male insert is sized to be inserted into a socket of a lighting string.

20. The article of claim 17, wherein the plurality of LEDs comprises a red LED, a blue LED, and a green LED.

21. The article of claim 17, wherein the plurality of LEDs are capable of being illuminated sequentially.

22. The article of claim 17, wherein the base comprises a circuit board.

23. The article of claim 17, the clip further including a void dimensioned to receive the wire from the lighting assembly.

24. The article of claim 17, wherein the male insert comprises a base and a husk, the husk including a pair of resilient tabs having a fixed end flexibly attached to and extending angularly from opposed sides of the husk in a coaxially aligned spaced apart relation, wherein each tab is adapted to deflect in a direction toward the opposed tab upon application of a biasing force and protrude in a direction away from the opposed tab upon removal of the biasing force.

25. The article of claim 17, wherein the plurality of LEDs of the lighting assembly illuminates the decorative element within the enclosure.

26. A decorative illuminated article adapted for use with a lighting string comprising:

a wiring assembly including a length of wire having a first end and a second end, the first end connected to a male insert, the second end connected to a lighting assembly;

a hollow enclosure including a decorative element contained therein and a neck adapted to receive the lighting assembly; and a clip attached to the wire for receiving a light bulb from the lighting string, the clip comprising a first segment and a second segment, the first segment and the second segment joined at one end, and a first void and a second void formed between the first segment and the second segment, the first void being dimensioned to receive a wire, and the second void being dimensioned to receive a light bulb.

27. The article of claim 26, wherein the lighting assembly is positioned to illuminate the decorative element in the hollow enclosure.

28. A decorative illuminated article adapted for use with a lighting string comprising:

a wiring assembly including a length of wire having a first end and a second end, the first end connected to a male insert, the second end connected to a lighting assembly;

a hollow enclosure including a decorative element contained therein and a neck adapted to receive the lighting assembly; and a clip, removably attached to the wire, for receiving a light bulb from the lighting string, having a first segment and a second segment, the first segment and the second segment joined at one end; and a first void and a second void formed between the first segment and the second segment, the first void is dimensioned to receive a wire, and the second void is dimensioned to receive a light bulb.

29. The article of claim 28, wherein the lighting assembly is positioned to illuminate the decorative element in the hollow enclosure.

30. A decorative illuminated article adapted for use with a lighting string comprising:

a wiring assembly including a length of wire having a first end and a second end, the first end connected to a male insert, the second end connected to a lighting assembly;

a hollow enclosure including a decorative element contained therein and a neck having an opening sized to receive the lighting assembly;

a collar having a hole through which the wire is inserted, the collar slidably positioned between the first end and the second end, the collar having an interior surface adapted to receive the neck and an exterior surface including decorative ribbing or knurls; and a clip removably attached to the wire, the clip including at least one circular void dimensioned to receive a light bulb from the lighting string.

31. The article of claim 30, wherein the lighting assembly is positioned to illuminate the decorative element in the hollow enclosure.

32. A decorative illuminated article adapted for use with a lighting string comprising:

a wiring assembly including a length of wire having a first end and a second end, the first end connected to a male insert, the second end connected to a lighting assembly;

a hollow enclosure including a decorative element contained therein and a neck having an opening sized to receive the lighting assembly; and a collar having a hole through which the wire is inserted, the collar slidably positioned between the first end and the second end, the collar having an interior surface adapted to receive the neck, the collar including an arcuate metal hanger; and a clip removably attached to the wire, the clip including at least one circular void dimensioned to receive a light bulb from the lighting string.

33. The article of claim 32, wherein the lighting assembly is positioned to illuminate the decorative element in the hollow enclosure.

34. A decorative illuminated article for use in connection to a pre-existing socket of a lighting string comprising a plurality of sockets that hold light bulbs, comprising:

a wiring assembly including a length of wire having a first end and a second end, the first end connected to a male insert, the second end connected to a lighting assembly;

a hollow enclosure including a decorative element contained therein and a neck having an opening sized to receive the lighting assembly;

a collar having a hole through which the wire is inserted, the collar slidably positioned between the first end and the second end, the collar having an interior surface adapted to threadably receive the neck; and a clip removably attached to the wire, the clip including at least one circular void dimensioned to receive a light bulb removed from the lighting string.

35. The article of claim 34, wherein the lighting assembly is positioned to illuminate the decorative element within the hollow enclosure.

36. A decorative illuminated article for use in connecting to a pre-existing socket of a lighting siring comprising a plurality of sockets that hold decorative light bulbs, comprising:

a wiring assembly including a length of wire having a first end and a second end, the first end connected to a male insert configured for insertion into one of the pre-existing sockets of the lighting string, the second end connected to a lighting assembly;

a hollow enclosure including a decorative element contained therein and a neck having an opening sized to receive the lighting assembly in a position to illuminate the decorative element;

a threaded gasket positioned around the neck;

a collar having a bole through which the wire is inserted, the collar slidably positioned between the first end and the second end, the collar having an interior surface adapted to receive the neck, wherein the interior surface of the collar is adapted to threadably receive the neck; and a clip removably attached to the wire, the clip including at least one circular void dimensioned to receive a light bulb from the lighting string.

* * * * *